US005522315A

United States Patent [19]

Behnke et al.

[11] Patent Number: 5,522,315

[45] Date of Patent: Jun. 4, 1996

[54] PRINTING BLANKET WITH CONVEX COMPRESSIBLE LAYER

[75] Inventors: Richard L. Behnke, Inman; Vernon O. Bridges, Spartanburg; W. Toriran Flint, Pauline; Joseph L. Byers, Inman, all of S.C.

[73] Assignee: Reeves International, Spartanburg, S.C.

[21] Appl. No.: 203,549

[22] Filed: Mar. 1, 1994

[51] Int. Cl.[6] ..... B41F 13/193

[52] U.S. Cl. ..... 101/376; 428/909

[58] Field of Search ..... 101/217, 375, 101/376, 379, 401.1, 492, 493; 428/909

[56] References Cited

U.S. PATENT DOCUMENTS

| | | | |
|---|---|---|---|
| 1,999,733 | 4/1935 | Luehrs | 428/909 |
| 3,795,568 | 3/1974 | Rhodarmer et al. | 161/87 |
| 4,015,046 | 3/1977 | Pinkston et al. | 428/422 |
| 4,042,743 | 8/1977 | Larson et al. | 428/306 |
| 4,681,035 | 7/1987 | Kobler et al. | 101/217 |
| 5,069,958 | 12/1991 | Burns, Jr. | 428/246 |

*Primary Examiner*—Edgar S. Burr
*Assistant Examiner*—Stephen R. Funk
*Attorney, Agent, or Firm*—Pennie & Edmonds

[57] ABSTRACT

A printing article which includes a rotatable metal support in the form of a cylinder and a compressible laminate mounted upon the support. The compressible laminate has upper and lower surfaces and a substantially uniform thickness and includes a printing face which forms the upper surface and a compressible layer positioned beneath the printing face. The upper surface of the compressible layer is spaced closer to the upper surface of the printing face in the center of the cylindrical support than at the ends. Preferably, this laminate is cylindrical and is in the form of a printing blanket or printing roll. The invention also relates to a method for forming the compressible laminate.

35 Claims, 3 Drawing Sheets

PRINTING BLANKET WITH CONVEX COMPRESSIBLE LAYER

FIELD OF THE INVENTION

This invention relates to elastomeric articles for use in lithographic printing applications, and in particular to compressible cylindrical printing blankets or rollers for use in offset printing presses.

BACKGROUND OF THE INVENTION

In the process of offset lithographic printing, a rotary cylinder is covered with a cylindrical surface referred to as a "printing plate" which has a positive image area that is receptive to oil-based inks and repellent to water as well as a background area that is repellent to the oil-based inks. The printing plate is rotated so that its surface contacts a second cylinder that is covered with a laminate having an ink-receptive rubber surface which is referred to as a "printing blanket". The ink present on the image surface of the printing plate transfers, or "offsets", to the surface of the printing blanket. Paper or other sheet stock to be printed is then passed between a nip formed by the blanket-covered cylinder and a rigid back-up cylinder or another blanket covered cylinder to transfer the image from the surface of the blanket to the paper. During the steps in which the image is transferred from the printing plate to the printing blanket and subsequently from the blanket to the paper, it is important to ensure intimate contact between the two contacting surfaces. This is ordinarily achieved by positioning the blanket-covered cylinder and the supporting cylinder or another blanket-covered cylinder that it contacts so that there is a fixed interference between the two. Therefore, the rubber-surfaced printing blanket laminate is generally compressed throughout the printing run to a fixed depth, typically about 0.002 to 0.006 inches.

If the printing blanket were constructed of solid rubber, it would bulge, or project radially away from the cylinder axis, in the areas adjacent to the nip when subjected to high nip pressure. This is because solid rubber cannot be reduced in volume and is therefore subject to lateral flow. Bulging would, of course, tend to distort the print image as well as possibly wrinkle the paper being printed. Therefore, compressible printing blankets have been developed.

To make the blanket compressible, a portion of the solid material making up the blanket is replaced by a gas, generally air. More specifically, layers beneath the surface of the blanket are constructed so as to contain millions of minute voids, which allow uniform compression to take place. As the voids beneath the area under pressure reduce in volume, they permit vertical compression—rather than lateral bulging—to take place at the cylinder nip. Conventional offset printing blankets generally include a multi-ply fabric base and a vulcanized elastomeric face. The threads of the fabric entrain a certain amount of air and provide voids and hence a certain amount of compressibility. To enhance the compressibility of such blankets, however, one or more cellular compressible layers is generally buried within or attached to one of the layers or fabrics between the base and the elastomeric face of the blanket.

Those skilled in the art have explored a wide variety of ways in which different open cell structures, closed cell structures, microspheres, and various combinations thereof can be used to obtain compressible layers that provide printing blankets having the desired compressibility properties. The numerous teachings of how to make compressible printing blankets include the teachings of Flint et al., U.S. Pat. No. 5,364,683; Larson U.S. Pat. No. 4,042,743; Shimura, U.S. Pat. No. 4,422,895; Rhodarmer et al., U.S. Pat. No. 3,795,568; Pinkston et al., U.S. Pat. No. 4,015,046; and Burns, U.S. Pat. No. 5,069,958.

In order to assure uniformity of printing, it is also important that compression be maintained uniformly over the entire length of the nip between the printing blanket and the support roll. Another important consideration relates to the handling of the paper or other webs being printed. Generally, cylindrical printing blankets used in various printing processes, are concaved on their outer surface to provide tension profiles across the width and between nips or contact points. Such tension profiles act to spread the web and prevent inward wrinkling.

FIG. 1 shows a structure representative of such concave-surfaced prior art cylindrical printing blankets. In this Fig., the printing blanket 1 is made of composite material. Two fabric layers 2 and 3 are joined together by an adhesive layer 4 to form a substrate. Compressible layer 5 is formed by using a binder, which may be made from a suitable resilient polymer matrix, into which closed cells are evenly introduced to form a compressible composite. Compressible layer 5 is adhered to fabric layer 3 by adhesive layer 6. A fabric 7 is adhered to compressible layer 5 by adhesive layer 8. The printing surface 9, for instance a solid elastomer such as a nitrile blend, is adhered to fabric layer 7 by adhesive layer 10.

The degree of concavity of printing surface 9 as shown in FIG. 1 is exaggerated for illustrative purposes. However, it is manifest that a printing blanket or other roll surface that is concaved across its width varies in circumference around its cross-section, and that a point at either edge of the roll will travel further during a rotation of the roll than will a point at the center of the roll. Although this concavity solves the problem of paper wrinkling which is often encountered in the printing art, it leads, on the other hand, to the formation of unequal printing pressures and nip areas across the width of the blanket which, in turn, can cause undesirable results during printing, such as substantial dot gain and decreased print contrast values. In addition, it has a negative impact on the web feed tendencies.

Thus it would be desirable to have a printing blanket or similar compressible roll product that exhibits a uniform thickness across its entire width yet which enables the provision of tension profiles across the width and between nips or contact points in order to spread the web and prevent inward wrinkling.

SUMMARY OF THE INVENTION

The present invention relates to a printing article comprising a rotatable metal support in the form of a cylinder and a compressible laminate mounted upon the support. The compressible laminate has upper and lower surfaces and a substantially uniform thickness and comprises a printing face which forms the upper surface and a compressible layer positioned beneath the printing face. The upper surface of the compressible layer is spaced closer to the upper surface of the printing face in the center of the cylindrical support than at the ends to achieve improvements in printing performance.

In this article, the upper surface of the compressible layer may have a number of profiles, including a parabolic profile, a central step, optionally including tapered sides, a plurality of graduated steps, a diamond-shape, or a center portion which is flat and end portions which radially taper toward the ends of the laminate. Advantageously, the support is a shaft and the compressible laminate forms a roller on the shaft or the support is a printing cylinder and the compressible laminate comprises a cylindrical printing blanket.

The invention also relates to the printing blanket itself. Such blankets generally include a number of additional layers or plys, such as at least one fabric or cord ply beneath the compressible layer or between the compressible layer and the elastomeric printing face. A subface formed from a high durometer, high tensile, low elongation elastomeric compound may be located beneath the printing face. Also, it is desirable for the printing face to have a surface profile with a roughness average of above about 0.6 and below about 0.95 microns.

The compressible layer generally includes cells formed from microspheres having a diameter of between about 1 and 200 microns or from gas bubbles trapped within a binder material. A protective coating of a material such as a fluorocarbon or a silicone can be provided on the fabric ply to prevent absorption and wicking of fluids therethrough, and the fabric ply can be a compressible fabric ply, if desired.

The invention also relates to a method of forming a compressible laminate by forming a compressible laminate having upper and lower surfaces and a substantially uniform thickness from at least a printing face which forms the upper surface and a compressible layer positioned beneath the printing face; and forming the upper surface of the compressible layer to have a profile with a raised central portion so that it is spaced closer to the upper surface of the printing face in the center of the laminate than at the ends.

This method may be carried out in a number of ways. Simply, it includes applying a substantially uniform thickness of the compressible layer and grinding the compressible layer to the desired profile. Alternatively, the method includes applying the compressible layer in the form of threads which carry a matrix of compressible material, and varying the amount of matrix material carried by the threads to increase the deposition of the matrix material toward the center of the laminate. The compressible layer may also be applied in the form of threads and a matrix of compressible material, and the drying rate of the matrix material may be varied across the width of the laminate prior to winding of the threads to thus allow for decreasing penetration of the threads into the matrix material toward the center of the laminate. In addition, the compressible layer may be applied in the form of a matrix of compressible material, and thereafter threads may be wound across the width of the laminate while varying the tension to thus allow for decreasing penetration of the threads into the matrix material toward the center of the laminate.

Furthermore, the compressible layer may be applied in the form of a matrix of compressible material, and thereafter the pressure on the compressible layer during pre-curing of the matrix material is varied to allow for decreasing density of the compressible layer toward the center of the laminate. Similarly, the compressible layer may be applied in the form of threads which carry a matrix of compressible material, and the speed of the cylinder during the winding of the threads may be varied to increase the deposition of the matrix material toward the center of the laminate.

These methods can be used to apply the compressible laminate in the form of a cylinder, either as a printing blanket or a printing roller.

Figure 1:
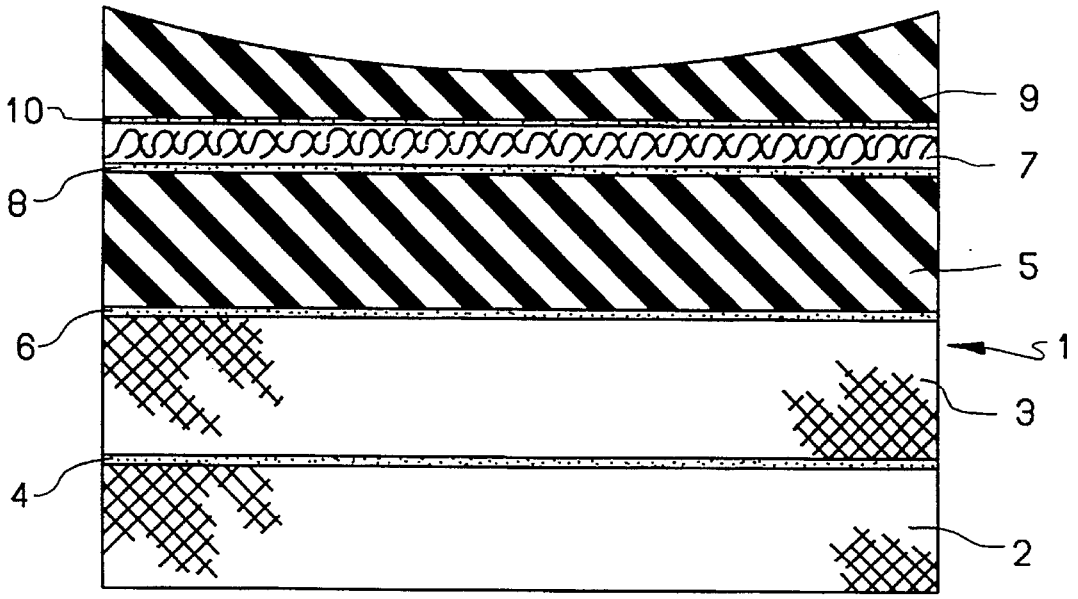
FIG. 1 Prior Art
FIG. 1 is an enlarged sectional view through a laminated compressible printing blanket that is representative of cylindrical prior art blankets.

FIGS. *2a–2b* are enlarged sectional views through laminated compressible printing blankets manufactured according to the present invention; and FIGS. *3a–3f* are a series of schematically-represented profiles that may be exhibited by the compressible layer within a printing blanket in accordance with the present invention.

DETAILED DESCRIPTION OF THE INVENTION

In its broadest aspect, the present invention contemplates a compressible elastomeric article for use with or as a cylindrical roll assembly. The article has an external surface which is of substantially uniform circumference across its width, and includes a compressible layer that has a thickness or profile which is greater in the center of the article than it is toward the ends. The compressible layer is generally embodied in articles which are generally known and referred to as printing blankets or printing rollers.

A printing blanket is generally comprised of several layers which are laminated into a single unitary structure. A description of the various layers which may be used in the present invention are described in Flint et al., U.S. Pat. No. 5,364,683, the content of which is expressly incorporated herein by reference thereto.

Those skilled in the art are well aware of how to make a wide variety of compressible layers, as evidenced by the teachings of Flint et al., as well as Larson, Shimura, Rhodarmer et al., Pinkston et al., and Burns, which are referred to above. The latter five patents are also expressly incorporated herein by reference to the extent necessary to understand the variations of how the compressible layer can be formed.

A wide variety of printing blankets are known in general to those skilled in the art. In accordance with the present invention, though, the printing blankets are constructed to have a substantially uniform thickness across their widths, despite that the compressible layers have a thickness or profile which is greater in the center than at the ends. This can be seen in FIG. *2a*.

In FIG. *2a*, the printing blanket 1 is made of composite material. Two fabric layers 2 and 3 are joined together by an adhesive layer 4 to form a substrate. Compressible layer 5 is formed by using a binder, which may be made from a suitable resilient polymer matrix, into which closed cells are evenly introduced to form a compressible composite. Compressible layer 5 is adhered to fabric layer 3 by adhesive layer 6.

As originally adhered to fabric layer 3, compressible layer 5 will generally be of uniform thickness. At this point, however, in accordance with the present invention, compressible layer 5 will be modified in thickness so that it remains thicker towards its center and becomes thinner towards its ends. A convenient means for achieving the desired thickness gradient is to grind or buff the stabilized layer to a parabolic convexity on an O.D. Grinder.

Figure 2A:
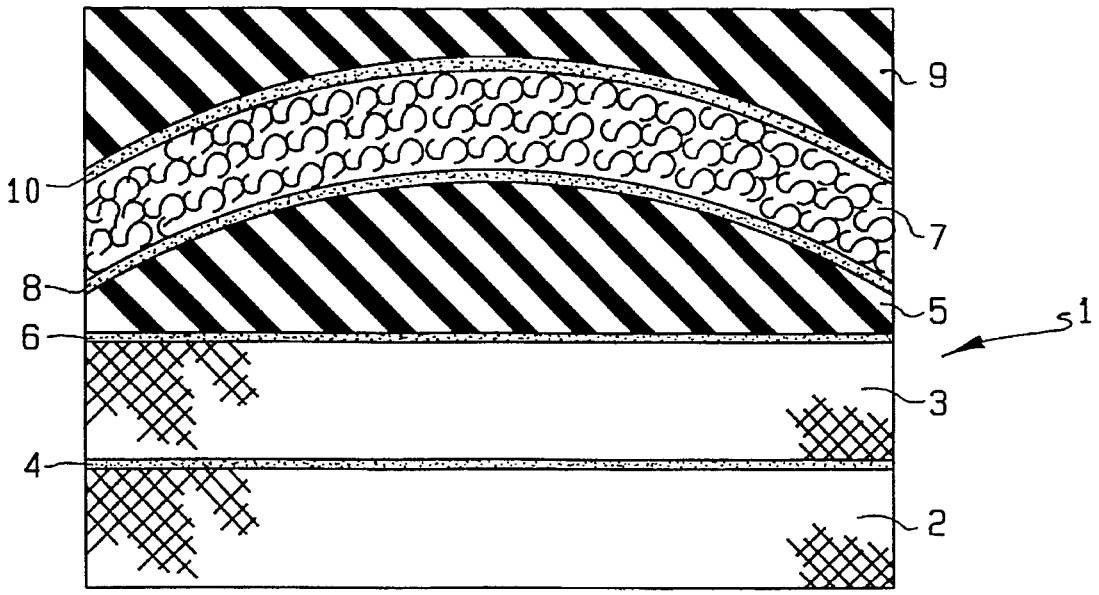
Figure 2B:
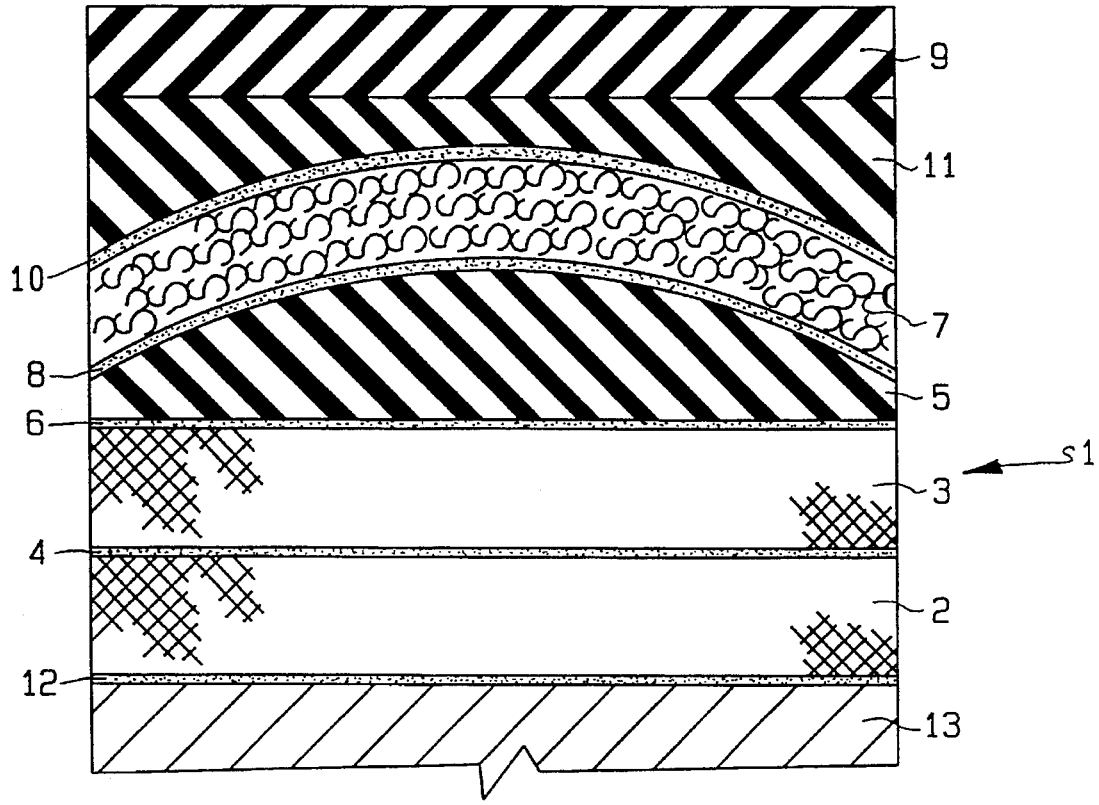

FIG. *2b* is similar in many respects to the construction shown in FIG. *2a*. FIG. *2b*, however, additionally illustrates several features of the present invention not shown in FIG. *2a*. First, blanket 1 is mounted upon a rotatable metal cylinder 13 adapted to support the blanket. In addition, protective coating 12 serves to adhere blanket 1 to cylinder 13 and to prevent absorption and wicking of fluids from cylinder 13 into blanket 1. Still further, blanket 1 in FIG. 2*b* is provided with a subface 11 located below printing face 9. Subface 11 is formed of a high durometer, high tensile, low elogation elastoneic compound.

Figure 3A:
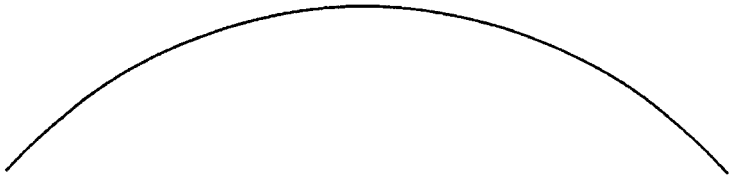
Figure 3B:
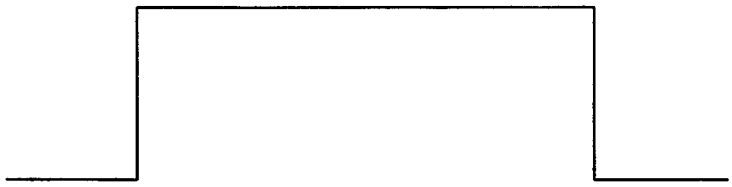
Figure 3C:
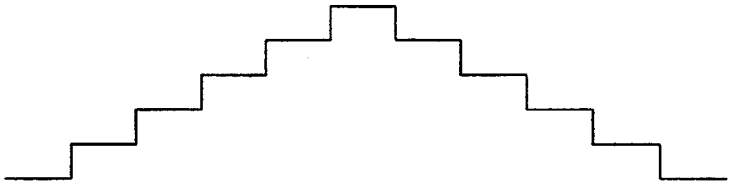
Figure 3D:
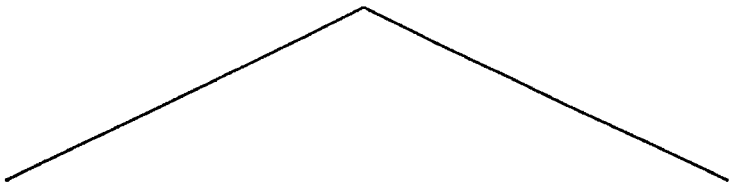
Figure 3E:
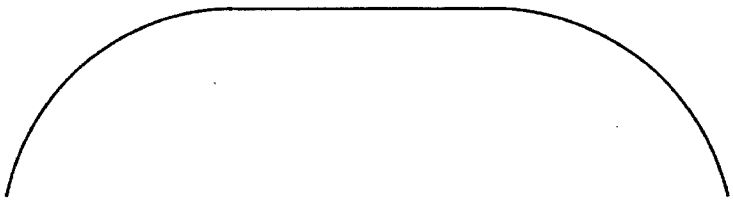
Figure 3F:
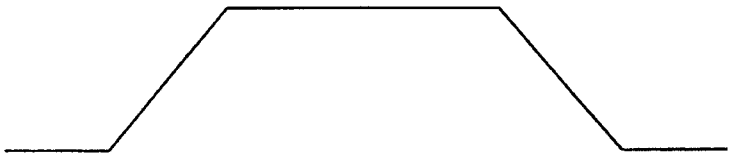

While a parabolic convexity will often be used due to the ease of achieving that profile, alternative grinding profiles are contemplated as being within the scope of the present invention. FIG. 3 shows the parabolic profile (FIG. 3*a*), a large central step profile (FIG. 3*b*), a profile consisting of graduated small steps (FIG. 3*c*), a diamond-shaped profile (FIG. 3*d*), a profile in which the ends have been radially ground (FIG. 3*e*), and a profile which has a center step and tapered sides (FIG. 3*f*). The degree of convexity of compressible layer 5 as shown in FIG. 2*a* and in FIG. 3 is exaggerated for illustrative purposes.

Compressible-layer profiles in accordance with the present invention may alternatively be made by means other than grinding a pre-formed conventional layer. The following procedures may be used to achieve the suitable profiles for use in this invention.

For instance, one may vary the thread/dip tank exit hole from small to large to small across the width of the article during the winding of the compressible layer to allow for increasing deposition of the compressible matrix toward the center of the width. Alternatively, one may variably dry the compressible matrix from less dry to more dry to less dry across the width prior to winding of the reinforcing layer to allow for decreasing penetration of the reinforcing threads into the compressible matrix toward the center of the width. One may also vary the reinforcing thread tension from high to low to high across the width to allow for decreasing penetration of the reinforcing threads into the compressible matrix toward the center of the width.

Additionally, one may variably pressurize the compressible layer from high to low to high across the width during stabilization or pre-curing to allow for decreasing density toward the center of the width. One may variably pressurize the completed composite from high to low to high across the width during curing to allow for decreasing density toward the center of the width. One may vary the traverse speed and/or the surface speed of the substrate/cylinder from fast to slow to fast during the winding of the compressible layer to allow for the increased deposition of the compressible matrix toward the center of the width. The precise profile, and the method of implementing it are not critical, so long as the profile results in a compressible layer that is less compressible towards its ends and more compressible towards its center.

Returning to FIGS. 2*a* and 2*b*, once compressible layer 5 has been modified to present thinned edges as described above, a fabric, cord or thread 7 is adhered to compressible layer 5 by adhesive layer 8. The printing surface 9, for instance a solid elastomer such as a nitrile blend, is adhered to fabric layer 7 by adhesive layer 10. As taught by Flint et al., Larson, Shimura, Rhodarmer et al., Pinkston et al., and Burns, cited above, printing surface 9 is often built up directly onto the substructure. There is thus no difficulty in achieving a bottom surface 11 for the printing face that corresponds to the configuration of the top surface of the compressible layer 5.

In accordance with the present invention, however, care should be taken to ensure that the top surface of the printing surface 9 is substantially flat, so that it will be positioned at a substantially uniform radius from the central axis of the roll across its entire width and around its entire circumference. In other words, the exterior surface of the blanket when mounted on a printing cylinder 13 in accordance with the present invention should be substantially cylindrical.

In addition to printing blankets, the principles of the present invention may be applied also to other similar printing and papermaking machine components such as impression blankets, plate cushions, and support and calendering rollers. In these designs, the present invention provides a compressible cylindrical roll assembly that comprises a metal shaft which is covered by a compressible laminate that has an external surface, for instance an elastomeric printing face, that is of substantially uniform circumference across its width. This compressible laminate includes a compressible layer which has an upper surface the circumference of which is greater in the center of the roll than it is toward both ends of the roll. Thus, the entire roll, rather than a printing blanket, is configured to include the desired compressible layer of the invention.

Although the preferred embodiments of the invention have been specifically described, it is contemplated that changes may be made without departing from the scope or spirit of the invention, and it is desired that the invention be limited only by the appended claims.

What is claimed is:

1. A printing article comprising a rotatable metal support in the form of a cylinder and a compressible laminate mounted upon the support, the compressible laminate having upper and lower surfaces and a substantially uniform thickness and comprising a printing face which forms the upper surface and a compressible layer having upper and lower surfaces positioned beneath the printing face with the upper surface of the compressible layer being spaced closer to the upper surface of the printing face in the center of the cylindrical support than at the ends.

2. The article of claim 1 wherein the upper surface of the compressible layer has a parabolic profile.

3. The article of claim 1 wherein the upper surface of the compressible layer has a central step.

4. The article of claim 3 wherein the central step has tapered sides.

5. The article of claim 1 wherein the upper surface of the compressible layer has a profile which includes a plurality of graduated steps.

6. The article of claim 1 wherein the upper surface of the compressible layer has a diamond-shaped profile.

7. The article of claim 1 wherein the upper surface of the compressible layer has a center portion which is flat and end portions which radially taper toward the ends of the laminate.

8. The article of claim 1 wherein the support is a shaft and the compressible laminate forms a roller on the shaft.

9. The article of claim 1 wherein the support is a printing cylinder and the compressible laminate comprises a printing blanket.

10. The article of claim 9 wherein the printing blanket is cylindrical.

11. The article of claim 9 wherein the printing blanket further comprises at least one fabric ply beneath the compressible layer.

12. The article of claim 11 which further comprises a protective coating on said fabric ply to prevent absorption and wicking of fluids therethrough.

13. The article of claim 12 wherein said protective coating comprises a fluorocarbon or a silicone material.

14. The article of claim 11 wherein the fabric ply is a compressible fabric ply.

15. The article of claim 9 wherein the printing blanket further comprises at least one fabric ply between the compressible layer and the printing face.

16. The article of claim 9 wherein the printing blanket further comprises a subface formed from an elastomeric compound, said subface located beneath said printing face.

17. The article of claim 9 wherein the printing face has a surface profile with a roughness average of above about 0.6 microns and below about 0.95 microns.

18. The article of claim 9 wherein the compressible layer includes cells formed from microspheres having a diameter of between about 1 and 200 microns.

19. The article of claim 9 wherein the compressible layer includes cells formed from gas bubbles trapped within a binder material.

20. A printing blanket having upper and lower surfaces and a substantially uniform thickness and comprising a printing face which forms the upper surface and a compressible layer having upper and lower surfaces positioned beneath the printing face with the upper surface of the compressible layer being spaced closer to the upper surface of the printing face in the center of the blanket than at the ends.

21. The blanket of claim 20 wherein the upper surface of the compressible layer has a parabolic profile.

22. The blanket of claim 20 wherein the upper surface of the compressible layer has a central step.

23. The article of claim 22 wherein the central step has tapered sides.

24. The blanket of claim 20 wherein the upper surface of the compressible layer has a profile which includes a plurality of small graduated steps.

25. The blanket of claim 20 wherein the upper surface of the compressible layer has a diamond-shaped profile.

26. The blanket of claim 20 wherein the upper surface of the compressible layer has a center portion which is flat and end portions which radially taper toward the ends of the blanket.

27. The blanket of claim 20 wherein the printing blanket further comprises at least one fabric ply beneath the compressible layer.

28. The blanket of claim 27 which further comprises a protective coating on said fabric ply to prevent absorption and wicking of fluids therethrough.

29. The blanket of claim 28 wherein said protective coating comprises a fluorocarbon or a silicone material.

30. The blanket of claim 27 wherein the fabric ply is a compressible fabric ply.

31. The blanket of claim 20 wherein the printing blanket further comprises at least one fabric ply between the compressible layer and the printing face.

32. The blanket of claim 20 wherein the printing blanket further comprises a subface formed from an elastomeric compound, said subface located beneath said printing face.

33. The blanket of claim 20 wherein the printing face has a surface profile with a roughness average of above about 0.6 microns and below about 0.95 microns.

34. The blanket of claim 20 wherein the compressible layer includes cells formed from microspheres having a diameter of between about 1 and 200 microns.

35. The blanket of claim 20 wherein the compressible layer includes cells formed from gas bubbles trapped within a binder material.

* * * * *